US009004502B2

(12) United States Patent
Van Horne et al.

(10) Patent No.: US 9,004,502 B2
(45) **Date of Patent: *Apr. 14, 2015**

(54) HOCKEY SKATE

(71) Applicant: Easton Sports, Inc., Van Nuys, CA (US)

(72) Inventors: Scott Van Horne, Calgary (CA); David Cruikshank, Delafield, WI (US); Neil Wensley, Valencia, CA (US); Dmitry Rusakov, Montreal (CA)

(73) Assignee: Easton Hockey, Inc., Van Nuys, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/226,486

(22) Filed: Mar. 26, 2014

(65) Prior Publication Data

US 2014/0202040 A1 Jul. 24, 2014

Related U.S. Application Data

(63) Continuation of application No. 13/418,052, filed on Mar. 12, 2012, now Pat. No. 8,684,368, which is a continuation-in-part of application No. 13/271,029, filed on Oct. 11, 2011, now Pat. No. 8,596,650, which is a continuation of application No. 12/609,627, filed on Oct. 30, 2009, now abandoned.

(51) Int. Cl.

| | |
|---|---|
| ***A43B 5/16*** | (2006.01) |
| ***A43B 23/26*** | (2006.01) |
| ***A63C 1/22*** | (2006.01) |

(52) U.S. Cl.

CPC ..... *A43B 5/16* (2013.01); *A43B 5/1691* (2013.01); *A43B 23/26* (2013.01); *A63C 1/22* (2013.01)

(58) Field of Classification Search

CPC .. A43B 5/1691; A43B 5/1666; A43B 5/1625; A43B 7/20; A43B 5/16; A43B 23/26; A63C 1/22

USPC ..... 280/11.12, 11.14, 11.15, 11.201, 280/11.224, 11.36, 841; 36/88, 93, 115, 36/117.6, 118.9

See application file for complete search history.

(56) References Cited

U.S. PATENT DOCUMENTS

| | | | | | |
|---|---|---|---|---|---|
| 2,789,374 | A | * | 4/1957 | Planert | 36/71 |
| 3,235,978 | A | * | 2/1966 | Hyde | 36/115 |
| 3,729,841 | A | * | 5/1973 | Wagner | 36/118.8 |
| 4,384,413 | A | * | 5/1983 | Bourque | 36/115 |
| 4,655,465 | A | * | 4/1987 | Schaeffer | 280/11.12 |
| 4,835,885 | A | * | 6/1989 | Hoshizaki et al. | 36/115 |
| D324,447 | S | * | 3/1992 | Purdom | D2/970 |
| 5,272,823 | A | * | 12/1993 | Perrissoud | 36/117.7 |
| 5,406,721 | A | * | 4/1995 | Marcolin | 36/103 |
| 5,408,763 | A | * | 4/1995 | Sartor et al. | 36/115 |
| 5,437,466 | A | * | 8/1995 | Meibock et al. | 280/11.202 |
| 5,498,033 | A | * | 3/1996 | Hoshizaki et al. | 280/841 |

(Continued)

*Primary Examiner* — Brodie Follman
(74) *Attorney, Agent, or Firm* — Perkins Coie LLP

(57) ABSTRACT

A skate assembly includes a shell structure and a removable tendon guard. The shell structure includes a heel portion, a lateral ankle portion, and a medial ankle portion. The heel portion is formed to cover a human heel. The lateral ankle portion is formed to extend beyond the heel portion. The medial ankle portion is formed to extend beyond the heel portion. The lateral ankle portion and the medial ankle portion are spaced apart to form a notch extending toward the heel portion. The removable tendon guard is removably attached between the lateral ankle portion and medial ankle portion to cover the notch.

20 Claims, 14 Drawing Sheets

(56) References Cited

U.S. PATENT DOCUMENTS

| | | | | |
|---|---|---|---|---|
| 5,933,986 | A * | 8/1999 | Donnadieu | 36/89 |
| 6,070,886 | A * | 6/2000 | Cornelius et al. | 280/11.223 |
| 6,070,887 | A * | 6/2000 | Cornelius et al. | 280/11.27 |
| 6,112,434 | A * | 9/2000 | Seltzer et al. | 36/115 |
| 6,217,036 | B1 * | 4/2001 | Rowledge | 280/11.15 |
| 6,367,818 | B2 * | 4/2002 | Meibock et al. | 280/11.221 |
| 6,550,159 | B1 * | 4/2003 | Madore | 36/115 |
| 6,769,203 | B1 * | 8/2004 | Wright et al. | 36/115 |
| 7,219,900 | B2 * | 5/2007 | Meibock | 280/11.27 |
| 7,290,773 | B2 * | 11/2007 | Eck | 280/11.12 |
| 7,325,813 | B2 * | 2/2008 | Bock | 280/11.19 |
| 7,398,609 | B2 * | 7/2008 | Labonte | 36/115 |
| 7,793,947 | B2 * | 9/2010 | Labonte | 280/11.12 |
| 8,109,536 | B2 * | 2/2012 | Labonte | 280/841 |
| 8,302,329 | B2 * | 11/2012 | Hurd et al. | 36/88 |
| 8,684,368 | B2 * | 4/2014 | Van Horne et al. | 280/11.12 |
| 8,745,898 | B2 * | 6/2014 | Stewart | 36/88 |
| 2001/0022434 | A1 * | 9/2001 | Sauter et al. | 280/11.221 |
| 2003/0196351 | A1 * | 10/2003 | Hipp et al. | 36/72 R |
| 2004/0194350 | A1 * | 10/2004 | Mazzarolo | 36/131 |
| 2004/0207164 | A1 * | 10/2004 | Meibock et al. | 280/11.221 |
| 2004/0226113 | A1 * | 11/2004 | Wright et al. | 12/145 |
| 2005/0116379 | A1 * | 6/2005 | Goldsmith et al. | 264/222 |
| 2005/0134010 | A1 * | 6/2005 | Blankenburg et al. | 280/11.18 |
| 2005/0193594 | A1 * | 9/2005 | Murphy | 36/89 |
| 2005/0229436 | A1 * | 10/2005 | Bock | 36/115 |
| 2006/0179686 | A1 * | 8/2006 | Labonte | 36/89 |
| 2006/0181035 | A1 * | 8/2006 | Labonte | 280/11.12 |
| 2008/0238006 | A1 * | 10/2008 | Labonte | 280/11.12 |
| 2009/0000151 | A1 * | 1/2009 | Cavasin | 36/97 |
| 2009/0188056 | A1 * | 7/2009 | Labonte | 12/142 P |
| 2009/0243238 | A1 * | 10/2009 | Van Horne et al. | 280/11.12 |
| 2012/0025478 | A1 * | 2/2012 | Van Horne et al. | 280/11.12 |
| 2012/0204452 | A1 * | 8/2012 | Van Horne et al. | 36/115 |
| 2014/0097583 | A1 * | 4/2014 | Vaughn | 280/11.12 |

* cited by examiner

HOCKEY SKATE

CROSS-REFERENCE TO RELATED APPLICATIONS

This application is a continuation of U.S. Ser. No. 13/418,052, filed Mar. 12, 2012, which is a continuation-in-part of U.S. Ser. No. 13/271,029, filed Oct. 11, 2011 and now granted as U.S. Pat. No. 8,596,650 on Dec. 3, 2013, which is a continuation of U.S. Ser. No. 12/609,627, filed Oct. 30, 2009 and now abandoned, all of which are incorporated herein by reference.

FIELD OF THE INVENTION

The present disclosure generally relates to skates, and more particularly, to hockey skates.

BACKGROUND

Ice skating and inline skating are rather unique forms of human locomotion. There a variety of sports that utilize ice (or inline) skates such as, for example, speed skating, hockey, and figure skating. A skate boot is generally constructed of a material upper (e.g., leather and/or other synthetic material) adhered to a last board. The base is bonded to an outer sole made of plastic, rubber, or composite fibers, which effectively sandwiches the folded edge of the material upper between the last board and the outer sole. The rigid parts of the skate boot are comprised of the sole piece and a counter piece, which in combination provide the support structure of the footwear.

Recently, the sport of hockey has demanded improved skate boot technology to allow athletes to reach higher speeds and/or accelerate faster. As such, many recent hockey skate designs have borrowed technology from speed skating for improved performance. For example, speed skates are known to be comprised of a stiff shell structure 100 such as the structure identified in FIG. 1. As shown, the shell structure 100 is a unitary structure that includes a rear portion 102 and bottom portion 104. The rear portion 102 is formed to cover the rear half of a human foot including the heel. The bottom portion 104 is attached to a skate blade at points 106, 108. Because of the unitary design of shell structure 100, lateral energy is not wasted when a skater pushes from side to side and thus the skater can realize increased speeds. In addition, as shown, the shell structure 100 only partially covers a human ankle and tapers toward the rear of the skate to give the skater improved range of motion of the foot. For example, when using the shell structure 100, the skater can move their foot up, down, left, and right. This increased movement, due to the shell structure 100 partially covering the ankle, can also improve the skaters speed and/or acceleration. Although, the shell structure 100 can improve a skaters speed and/or acceleration, it is not practical for hockey because the design does not include many desired safety features required to protect the skater from impacts such as from, inter alia, pucks, sticks, and skate blades.

One common safety feature of a hockey skate is a tendon guard. Tendon guards are usually permanently attached to a rear of the skate that extends above a skater's ankle and extend upward therefrom in order to protect the skaters tendon from impacts. Although tendon guards serve a useful purpose, they can reduce movement of a skater's foot most notably upward and downward movement (e.g., dorsiflexion and planarflexion), which is undesirable.

Some skates have a tendon guard that is more flexible than the outer shell of the skate allowing the tendon guard to flex backwards and thus improving the movement of the skater's foot. These tendon guards are attached to the top of an ankle portion of the outer shell in a variety of ways such as, for example, via stitching, over molding, thermal bonding, high frequency welding, vibration welding, piping, zipper, adhesive, and staples. Accordingly, these tendon guards flex at the point of attachment, which can provide increased mobility of the skater's foot. However, movement of the skater's foot is still somewhat restricted because the ankle portion of the stiff outer shell covers the lower portion of the skater's Achilles tendon.

Accordingly, a need exists for an improved skate boot that can increase a skater's speed and acceleration while still providing adequate ankle support and protection for impact sports such as hockey.

BRIEF DESCRIPTION OF THE DRAWINGS

The invention will be more readily understood in view of the following description when accompanied by the below figures, wherein like reference numerals represent like elements.

DETAILED DESCRIPTION

In one example, a skate assembly includes a shell structure and a removable tendon guard. The shell structure includes a heel portion, a lateral ankle portion, and a medial ankle portion. The heel portion is formed to cover a human heel. The lateral ankle portion is formed to extend beyond the heel portion. The medial ankle portion is formed to extend beyond the heel portion. The lateral ankle portion and the medial ankle portion are spaced apart to form a notch extending downward toward the heel portion. The removable tendon guard is removably attached between the lateral ankle portion and medial ankle portion to cover the notch.

The skate assembly provides, among other advantages, increased mobility of a skater's foot, which can increase skating speed and/or acceleration of the skater. In addition, the skate assembly provides safety features suitable for impact sports such as hockey without compromising the mobility of the foot. Other advantages will be recognized by those of ordinary skill in the art.

Figure 1:
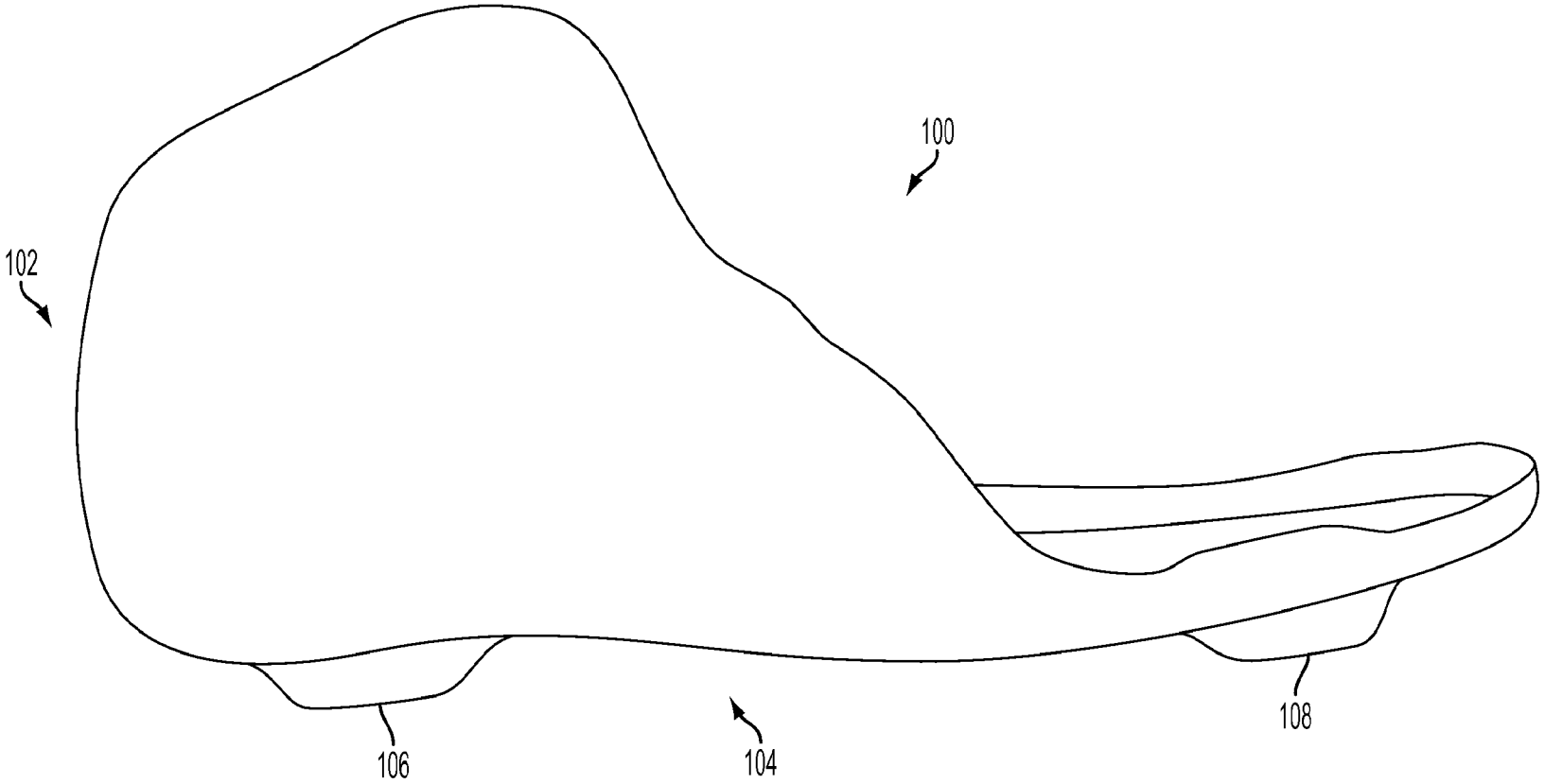
FIG. 1 PRIOR ART
FIG. 1 is an exemplary diagram of a speed skate shell according to the prior art.
Figure 2:
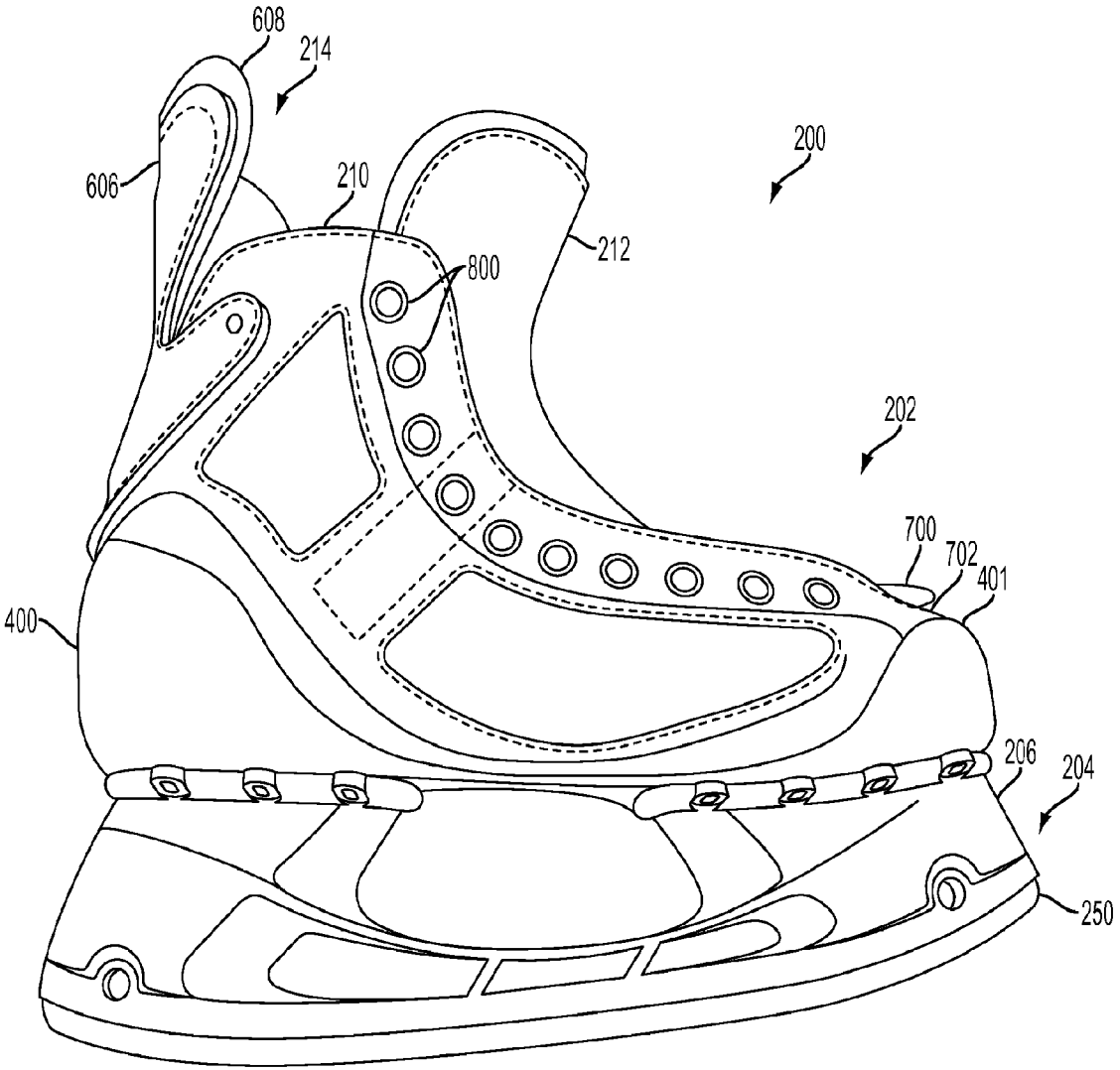
FIG. 2 is an exemplary diagram of a skate according to the present disclosure.
Figure 3:
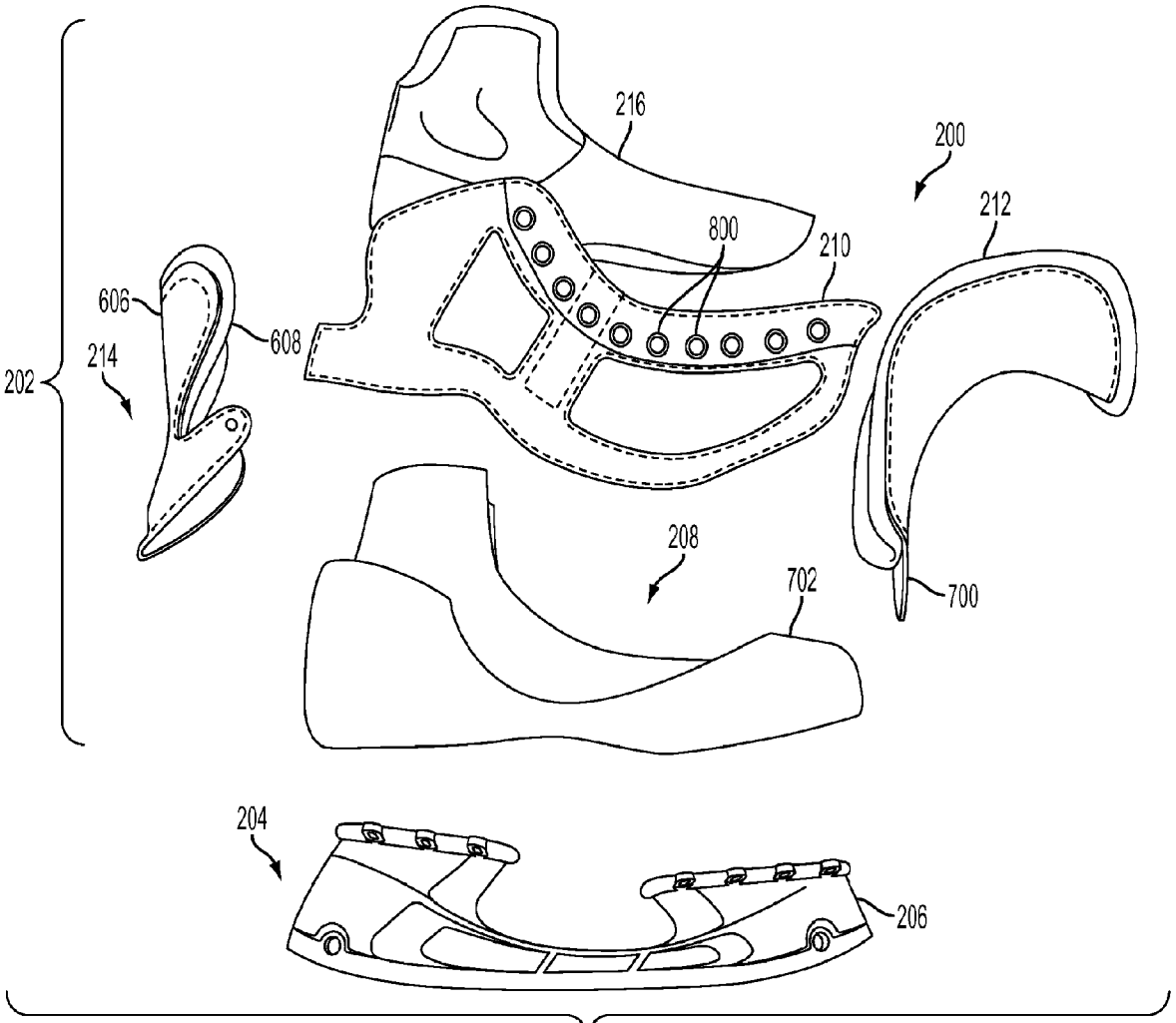
FIG. 3 is an exemplary exploded diagram of the skate.

Referring now to FIGS. 2 and 3, an exemplary diagram of a skate 200 such as an ice skate or inline roller skate is depicted. The skate 200 includes a skate boot 202 and a blade assembly 204. The blade assembly 204 includes a blade holder 206 and a skate blade 250. The blade holder 206 receives and secures the skate blade 250 in place.

The skate boot 202 includes a stiff unitary shell structure 208, a side panel 210 on the medial and lateral side of the skate boot 202, a removable tongue 212, a removable tendon guard 214, and an inner liner 216. The shell structure 208 can be made of any suitable stiff material such as for example, carbon fiber, aramid fiber, such as KEVLAR®, heat moldable thermoplastic, such as by Rhenoflex Corp of Germany, or other suitable thermoplastics that softens at a temperature under 80° C. For example, in one embodiment, the shell structure 208 can include a layer of carbon fiber, a layer of aramid fiber, and a layer of thermoplastic. In this example, the layer of aramid fiber can be sandwiched between the layer of carbon fiber and the layer of thermoplastic. In addition, the layer of carbon fiber can provide a hard exterior surface to the shell structure 208 and the layer of thermoplastic can provide a heat moldable interior of the shell structure 208.

The shell structure 208 can be manufactured in any suitable manner known in the art. For example, the shell structure 208 can be manufactured using a wet lay-up process. In this process, the thermoplastic is heated and shaped to a foot last. Next, pre-impregnated (pre-preg) carbon fiber and aramid fiber are layered over and onto the foot last. Thereafter, the layers on the foot last are vacuum bagged and heated until cured.

The thermoplastic is positioned over areas of the foot where maximal variation from individual to individual can occur such as the arch (or instep), ankle, metatarsus, and/or other suitable portions of the foot. In areas of the foot that have less shape variance, composite fibers can be used to provide a rigid and lightweight structure. The thermoplastic is designed to melt at a temperature at or around 60° C., although other suitable thermoplastics are contemplated. As such, the skate 200 can be placed in a conventional oven at or around 60° C. for approximately 20 minutes. Thereafter, the thermoplastic portions of the shell structure 208 can be easily formed to a particular foot.

Figure 4:
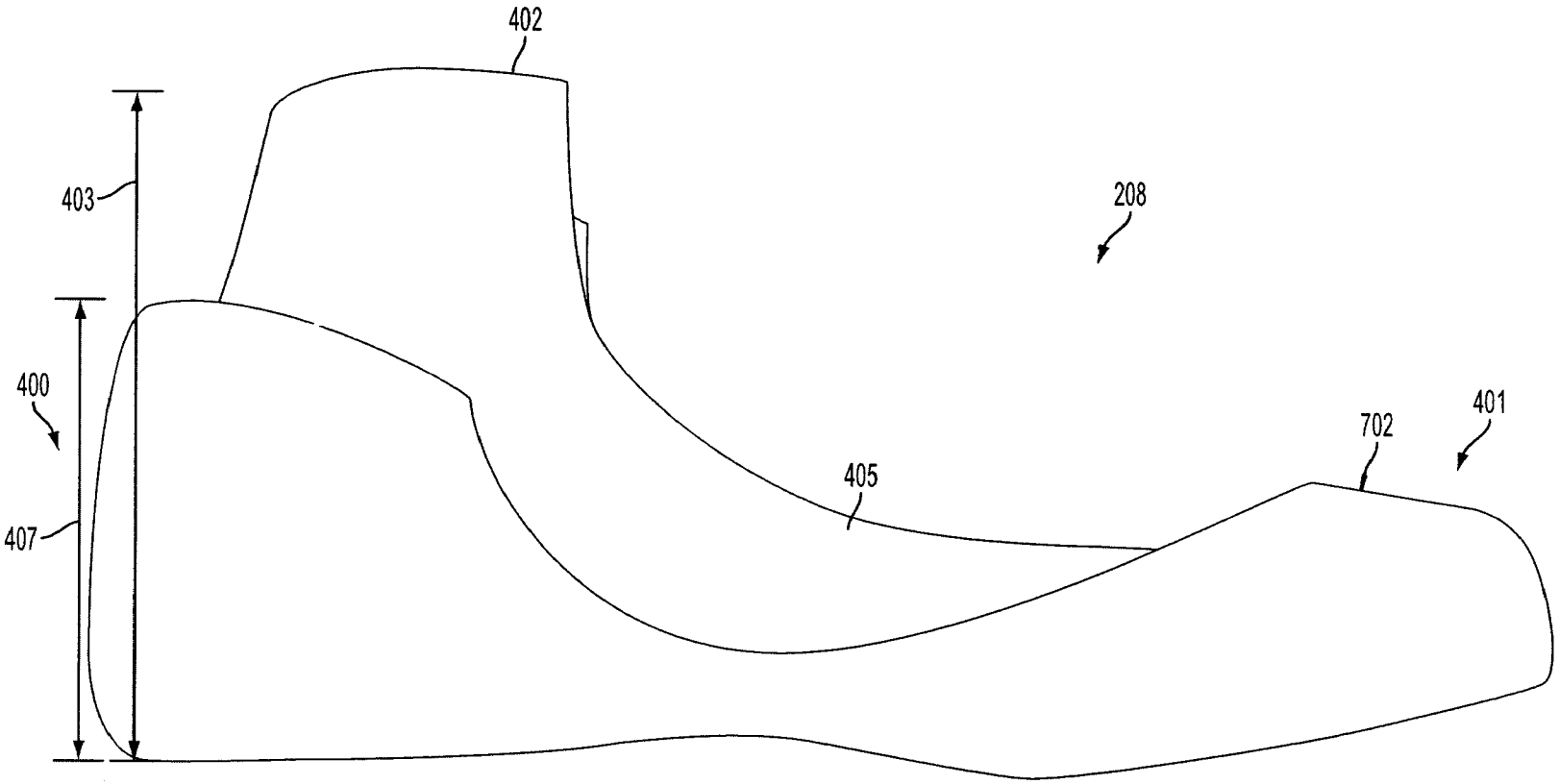
FIG. 4 is an exemplary side diagram of a shell structure of the skate.
Figure 5:
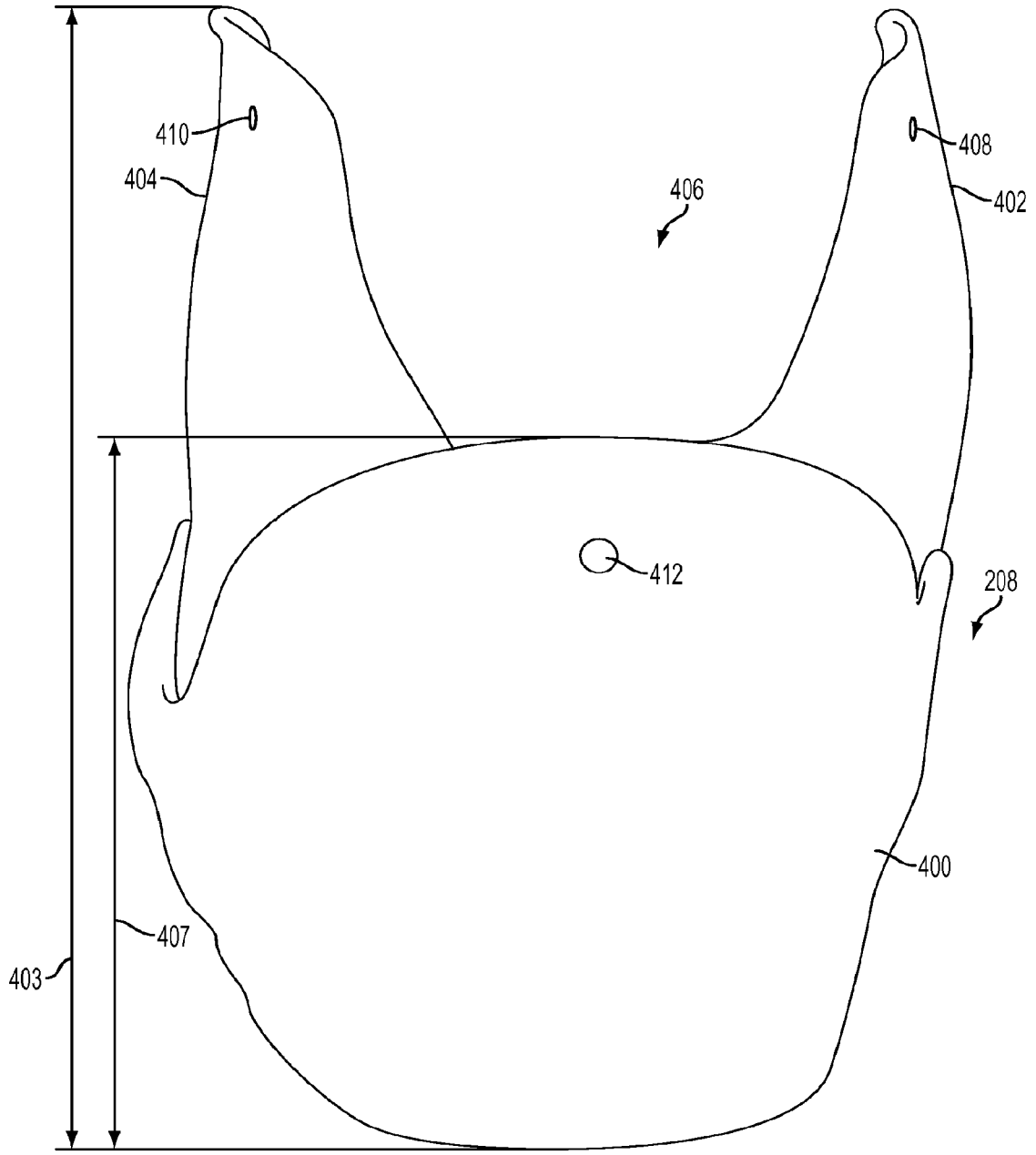
FIG. 5 is an exemplary rear diagram of the shell structure.

Referring now to FIGS. 4 and 5, the shell structure 208 includes a heel portion 400, a toe portion 401, a medial ankle portion 402, a lateral ankle portion 404, and an arch structure 405. The heel portion 400 is formed to cover a human heel. The toe portion 401 is formed to cover one or more human toes thereby providing protection thereto. The medial ankle portion 402 and the lateral ankle portion 404 are formed to extend beyond the heel portion 400 in order to cover and protect a human ankle. For example, in one embodiment, the heel portion 400 can have a heel height 407 that is approximately 65% of the ankle height 403 although other ratios are contemplated. The medial ankle portion 402 and the lateral ankle portion 404 are spaced apart to form a notch 406 extending toward the heel portion 400. In one example, the medial ankle portion 402 and the lateral ankle portion 404 are spaced apart by approximately 50 mm to 68 mm although other widths are contemplated. For example, in one embodiment, a size 6 has a notch spacing of approximately 60 mm, and a size 12 has a notch spacing of approximately 68 mm. The notch 406 begins just above a human heel in order to allow the Achilles tendon to move within the notch 406 thereby increasing a skater's range of motion when moving their foot up and down. As such, the notch 406 allows for increased (or in some circumstances uninhibited) movement of the ankle joint.

When the skate boot 200 is fully assembled, the removable tendon guard 214 is removably attached between the medial ankle portion 402 and the lateral ankle portion 404 to cover the notch. More specifically, the medial ankle portion 402 and the lateral ankle portion 404 are removably attached to the removable tendon guard 214. In addition, the removable tendon guard 214 can be removably attached to heel point 412 to further secure the removable tendon guard 214 to the shell structure 208. As such, the combination of the notch 406 and the removable tendon guard 214 provides increased (or in some cases uninhibited) flexion and/or extension while protecting the Achilles tendon.

As shown, the arch structure 405 is positioned between the heel portion 400 and the toe portion 401 and is proximate the medial ankle portion 402. The arch structure 405 is formed to fit the medial longitudinal arch of a human foot in order to provide arch support for the foot. The arch structure 405 can be made of any suitable material. For example, in one embodiment, the arch structure 405 can be made of a heat moldable thermoplastic that becomes moldable at a sufficient temperature (e.g., 60° C.) such that the foot will not be burned. As such, in this embodiment, the arch structure 405 can be custom molded to each individual foot for greater comfort and fit.

Likewise, in one embodiment, the medial ankle portion 402 and the lateral ankle portion 404 can also be made of a heat moldable thermoplastic that becomes moldable at a sufficient temperature (e.g., 60° C.) such that the foot will not be burned. Accordingly, the medial ankle portion 402 and the lateral ankle portion 404 can be custom molded to each individual's foot for greater comfort and fit.

Figure 6:
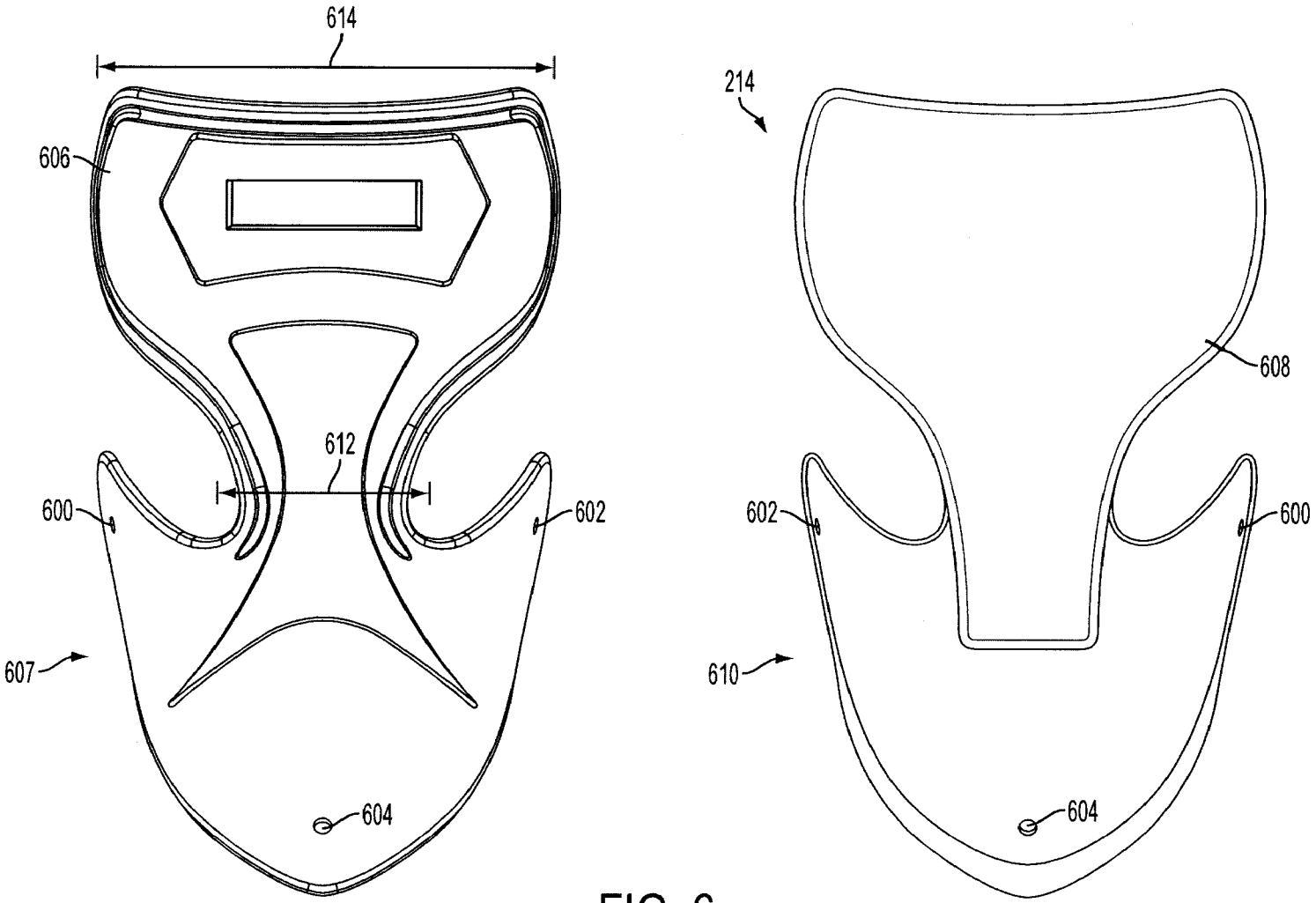
FIG. 6 is an exemplary diagram of a removable tendon guard according to the present disclosure.

Referring now to FIG. 6, an exemplary diagram of the removable tendon guard 214 is depicted. The removable tendon guard 214 can be removably attached to the skate boot 202 attached between the medial ankle portion 402 and lateral ankle portion 404 to cover the notch 406. More specifically, the removable tendon guard 214 includes a first attachment point 600 and a second attachment point 602. The first attachment point 600 can be removably attached to the lateral ankle portion 404 via lateral ankle point 410 and the second attachment point 602 can be removably attached to the medial ankle 402 via media ankle point 408. In addition, the removable tendon guard 214 can also include a third attachment point 604, which can be removably attached to heel point 412 to further secure the removable tendon guard 214 to the skate boot 202. The attachment points 600, 602, 604 can be removably attached to the skate boot 202 in any suitable manner. In one embodiment, the attachment points 600, 602, 604 can be removably attached to the skate boot 202 via bolts that pass through tendon guard holes and tighten to t-nuts that are anchored into the shell 208. Other suitable attachment methods are contemplated.

The removable tendon guard 214 can include an exterior portion 606 generally identified at 607 and an inner portion 608 generally identified at 610. The exterior portion 606 provides the main support structure and can be made of any suitable rigid material that provides pliability. For example, in one embodiment, the exterior portion 606 can be an injection molded plastic piece such as a pebax Nylon elastomer, ST 801 Dupont PS Nylon 66, or other suitable material. The inner potion 608 is a padded material to provide comfort when making contact with the Achilles tendon and/or other parts of the lower leg. In one embodiment, the inner portion 608 can be comprised of suitable comfort foam wrapped in a piece of CLARINO™ liner material although other materials are contemplated.

The removable tendon guard 214 has a narrow mid-channel design. More specifically, the mid channel 612 is narrower and has a smaller dimension than the top width 614 of the removable tendon guard 214. The mid channel 612 can be any suitable width that is smaller than the top width 614. For example, in one embodiment, the mid channel 612 has a width that is ⅓ of the top width 614. In other embodiments, the mid channel 612 can be any suitable width that is less than 59% of the top width 614 although other dimensions are contemplated. The narrower mid channel 612 and corresponding notch 406 in the shell structure 208 allow a human ankle joint to extend more freely. For example, the back portion of the lower leg and Achilles tendon can pass through the notch 406 and engage the removable tendon guard 214, which allows continued movement through the increased flex allowed by the mid channel 612.

Figure 12:
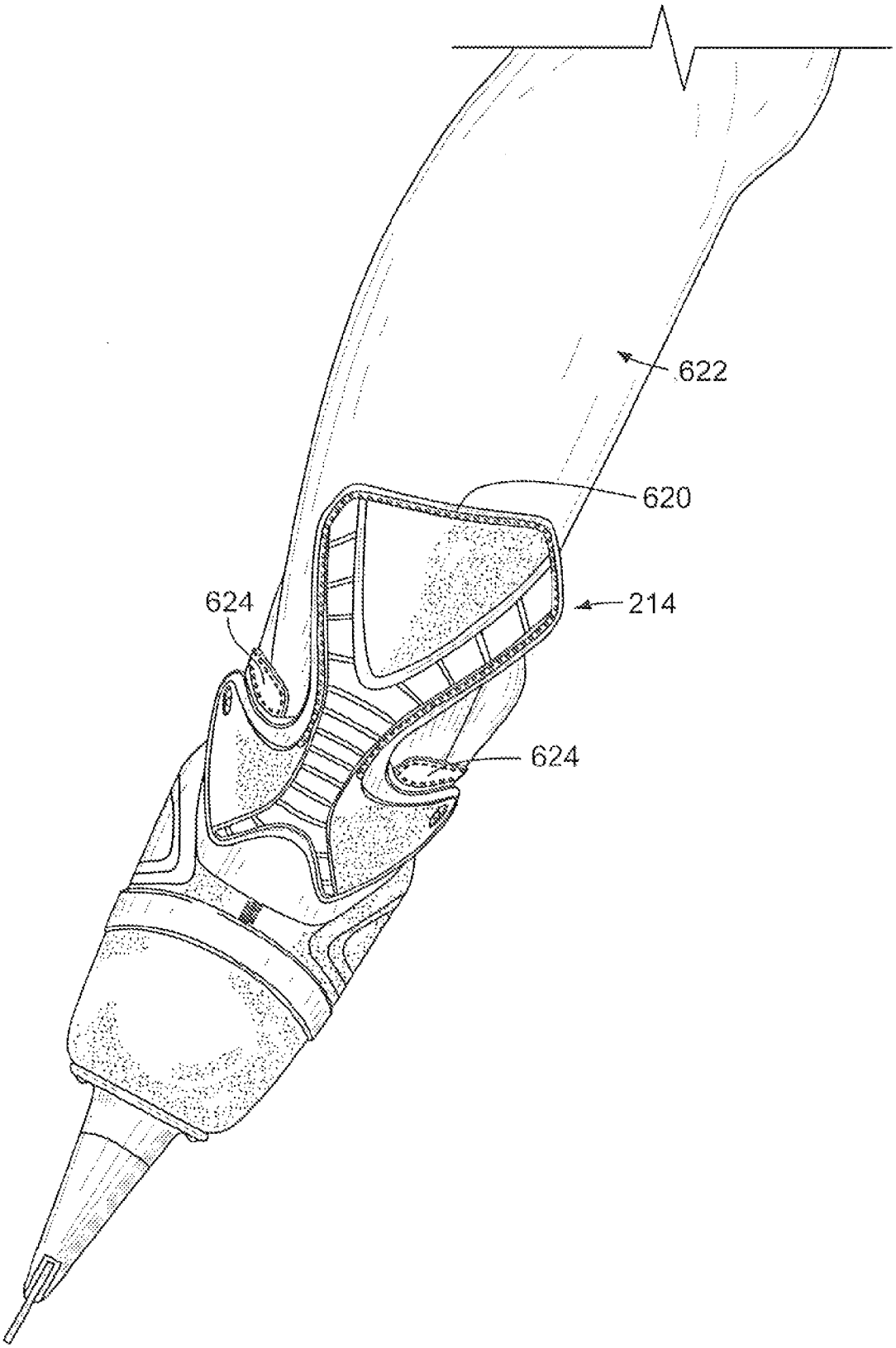
FIG. 12 is an exemplary rear diagram of the skate shown in FIG. 11 with the wearer's leg angled outwardly such that the blade is angled on the ice.

Referring now to FIGS. 11-14, in another embodiment, the removable tendon guard 214 includes a sloped or angled upper edge 620 such that, from a rear view, the tendon guard 214 is asymmetrical. In this embodiment, the upper edge 620 slopes downwardly generally from the medial side to the lateral side of the tendon guard 214. This configuration provides additional freedom of movement for a wearer's leg 622 in the rearward direction, particularly when the wearer's leg 622 is angled outwardly during a skating motion, as shown in FIG. 12.

Additionally, the height X of the lateral ankle portion of the skate boot may be less than the height Y of the medial ankle portion of the skate boot to provide additional freedom of movement for the wearer's leg 622 in the lateral and rearward directions during a skating motion. In one embodiment, the lateral ankle height X may be approximately 5 mm less than the medial lateral height Y. For example, the lateral height X may be approximately 152 mm, while the medial height Y may be approximately 157 mm. Other heights and height variations may alternatively be used.

Figure 13:
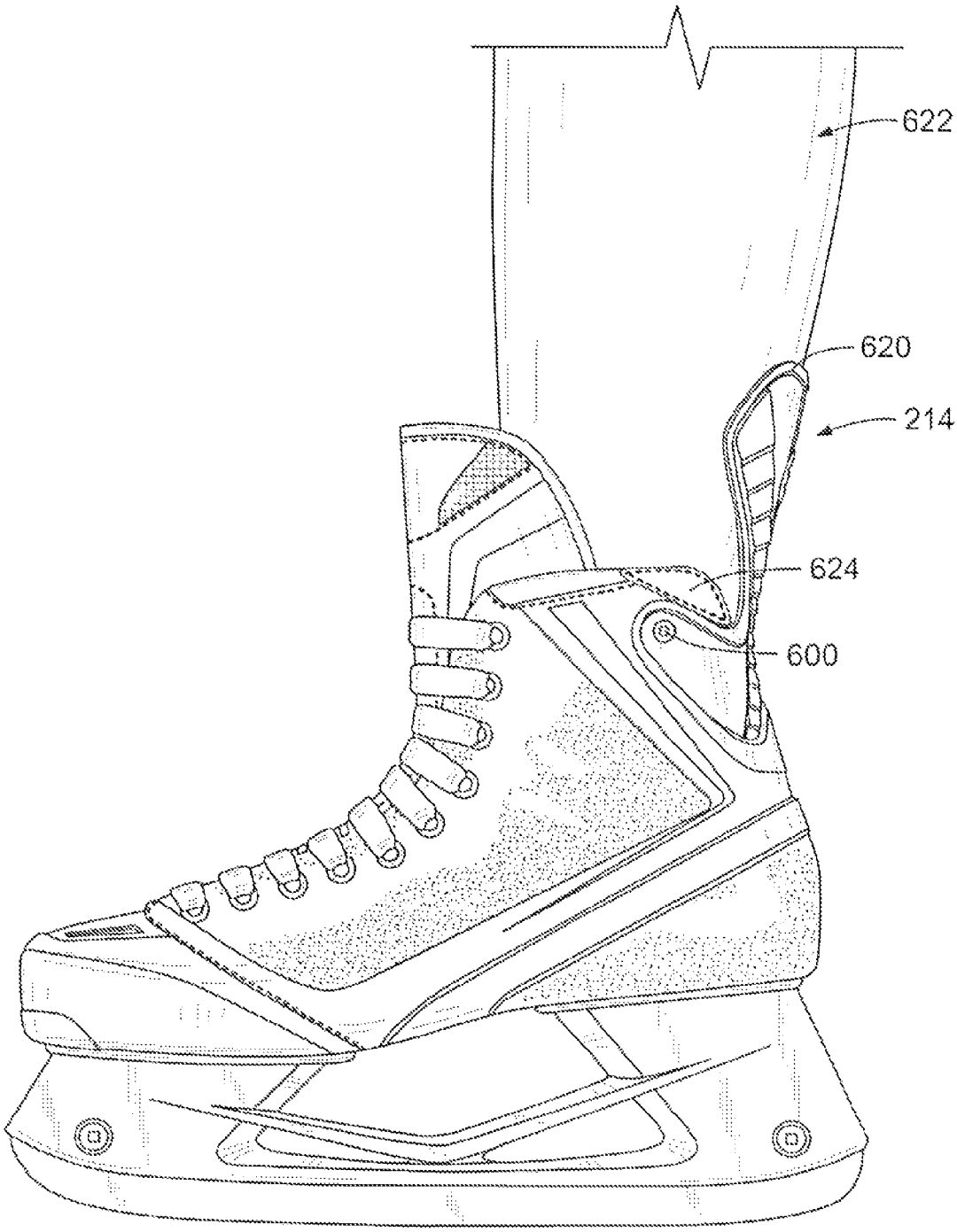
FIG. 13 is an exemplary side diagram of the skate shown in FIGS. 11 and 12 with the wearer's leg extended toward the back of the skate.
Figure 14:
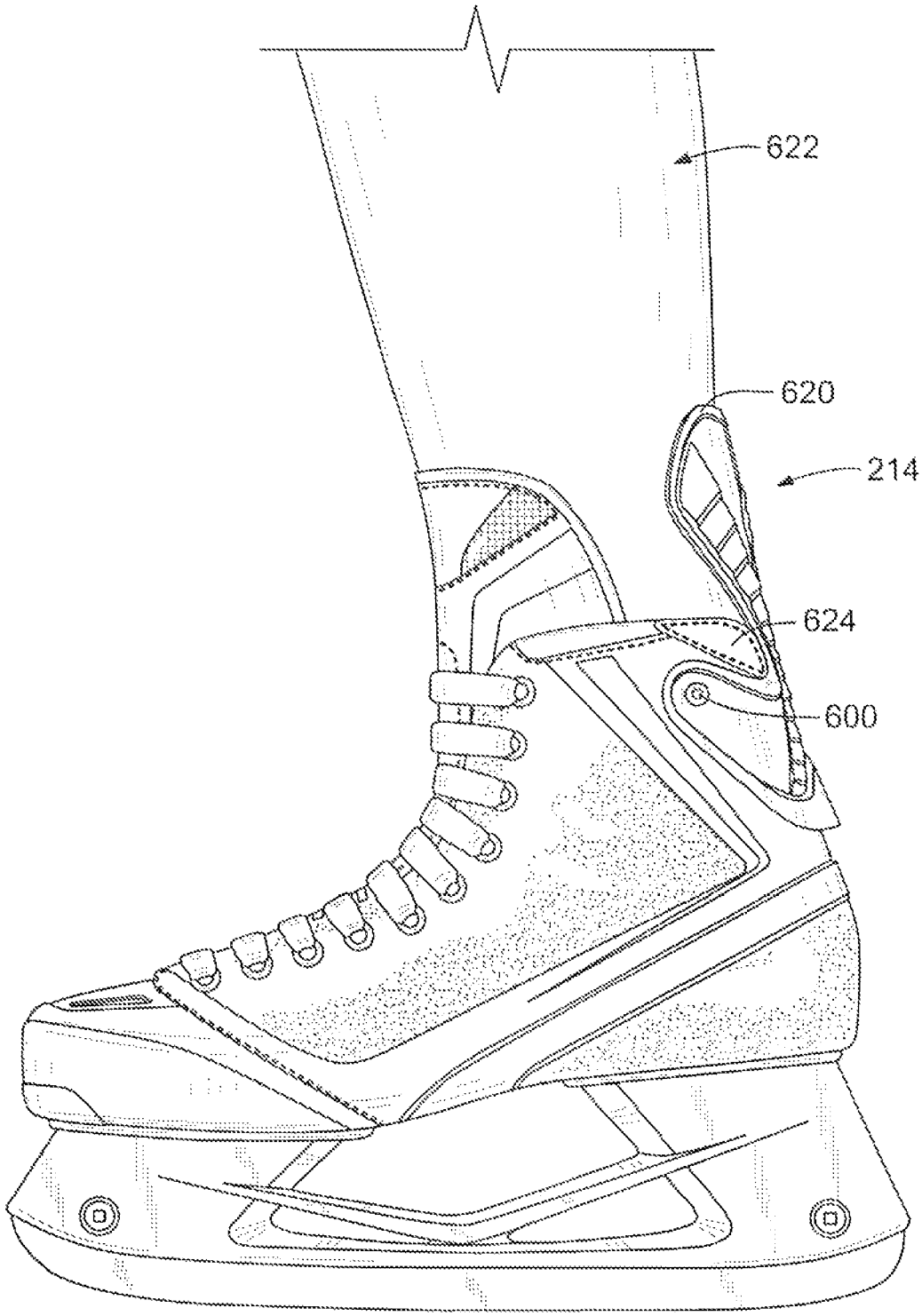
FIG. 14 is an exemplary side diagram of the skate shown in FIGS. 11-13 with the wearer's leg extended toward the front of the skate.

In one embodiment, the lower attachment point 604 may be omitted from the tendon guard such that the tendon guard 214 is attached to the boot only at the medial and lateral attachment points 600, 602. In this embodiment, stoppers 624 may be included on rear-upper portions of the medial and lateral ankle portions 402, 404. The stoppers 624 inhibit appreciable forward movement or forward pivoting of the tendon guard 214 above the attachment points 600, 602 when the wearer's leg is angled forward in the boot. FIG. 13 illustrates the wearer's leg angled in a rearward direction such that the upper region of the tendon guard 214 is flexed rearwardly and the tendon guard 214 is spaced apart from the stoppers 624. FIG. 14 illustrates the wearer's leg angled in a forward direction such that the upper region of the tendon guard 214 is free to pivot forward until the tendon guard 214 engages the stoppers 624.

The stoppers 624 may be injection-molded components that are stitched to the medial and lateral ankle portions or that are formed as unitary portions of the medial and lateral ankle portions. The stoppers 624 may alternatively be made in any other suitable manner, and may be attached in any other suitable manner.

Figure 7:
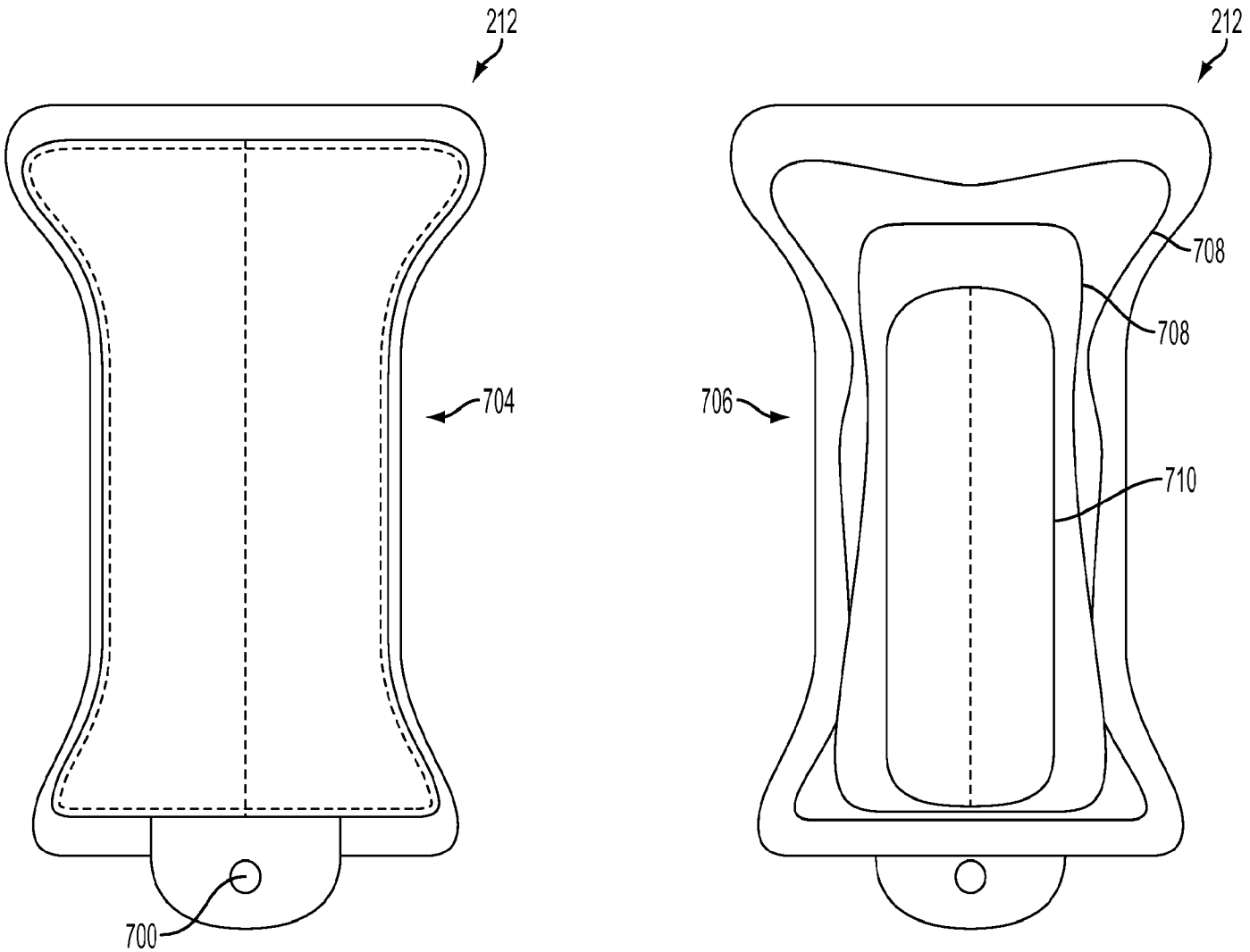
FIG. 7 is an exemplary diagram of a removable tongue according to the present disclosure.

Referring now to FIG. 7, an exemplary diagram of the removable tongue 212. The removable tongue 212 can be removably attached to the toe portion of 401 of the shell structure 208. For example, in one embodiment, the removable tongue 212 can include a tongue attachment point 700 that can be removably attached to a toe attachment point 702 of the shell structure 208 as depicted in FIGS. 2, 3, and 4. In one embodiment, the removable tongue 212 can be removably attached to the toe portion 401 via a bolt (or other structure) that fastens to a t-nut that is housed in the toe portion 401 proximate the toe attachment point 702. The removable tongue 212 simplifies manufacturing since the skate boot 202 and the removable tongue 212 can be manufactured separately and attached during final assembly. In addition, the removable tongue 212 can be easily replaced should it become damaged or for any other reason.

Referring back to FIG. 7, the removable tongue 212 can include an exterior portion 704 and an inner portion 706. In one embodiment, the removable tongue 212 is comprised of one or more layers of foam layers 708. For example, in one embodiment, two foam layers are used that have different densities. In this example, the softer layer can be positioned proximal a skater's foot and the stiffer layer can be positioned on top of the soft layer (e.g., distal the skater's foot). This configuration can be advantageous in that it provides comfort to the skater's foot and can reduce (or in some cases prevent) lace bite (e.g., the effect of laces causing localized pressure on the top the foot resulting in soreness and bruising).

The removable tongue 212 is also comprised of one or more pieces of thermoplastic 710 that softens at or around 60° C. for safe anatomical shaping. In one embodiment, the removable tongue 212 is also comprised of two pieces of thermoplastic 710. The thermoplastic 710 can be bonded to the tongue in any suitable location such as the outermost foam layer 708, for example. The thermoplastic 710 provides rigidity and support to the tongue. In addition, when heated, the removable tongue 212 can be custom shaped to a particular skater's foot. The foam layer 708 and the thermoplastic 710 can be covered with a thin piece of black felt material to provide added comfort if desired.

Figure 8:
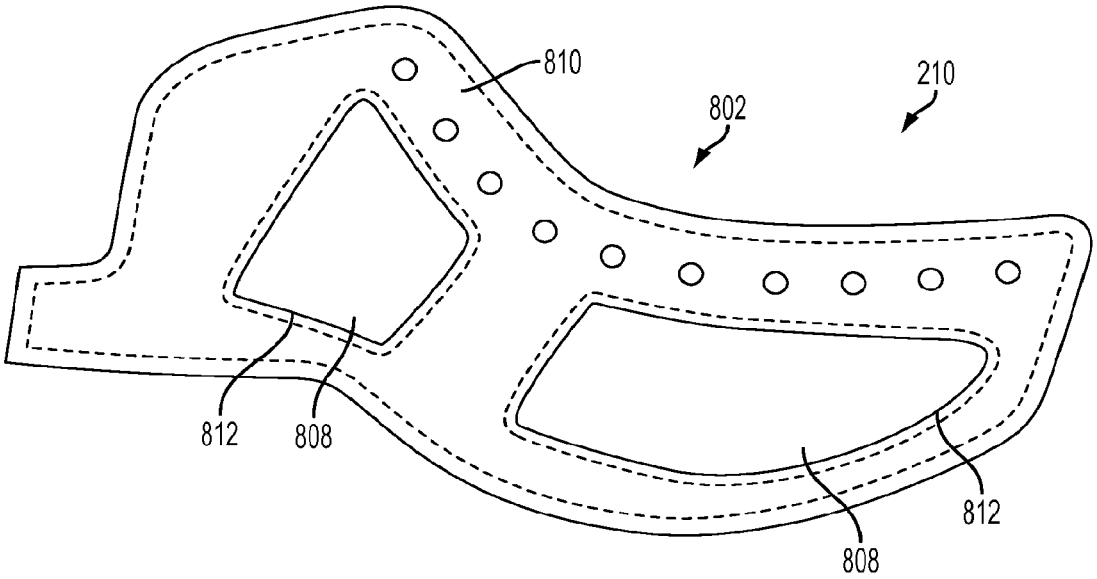
FIG. 8 is an exemplary diagram of a side panel of the skate.
Figure 8:
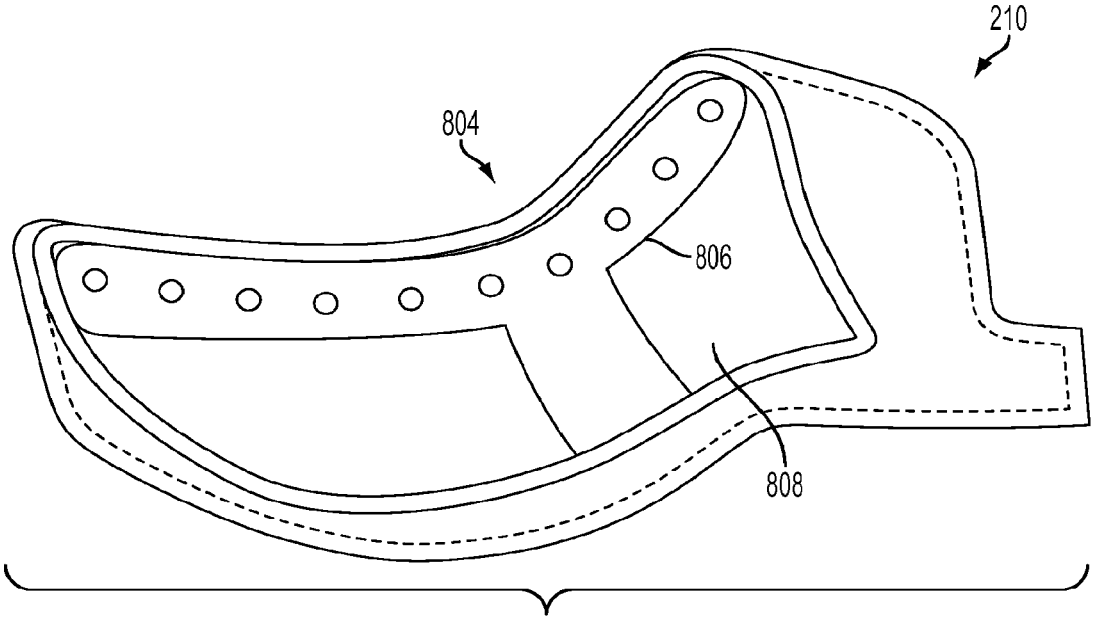

Referring now to FIG. 8, an exemplary diagram of the side panel 210 is depicted. The side panel 210 can include an exterior portion 802 and an inner portion 804. The side panel 210 is bonded to the shell structure 208 and stitched to the inner liner 216 of the skate boot 202. The side panel 210 can be bonded to the shell structure 208 using any suitable solvent based adhesive such as contact cement or other suitable adhesive.

The side panel 210 supports and houses eyelets 800. As such, the side panel 210 is reinforced with a reinforcement material 806 in order to prevent tearing when the skate boot 202 is laced up. Any suitable material can be used to reinforce the side panel 210 such as an aramid fiber material (e.g., KEVLAR®) for example. In addition, the side panel 210 can include a thermoplastic 808 that softens at or around 60° C. for safe anatomical shaping. The thermoplastic 808 further supports and gives rigidity to the eyelets 800. Furthermore, the side panel 210 can be heat shaped to the skate 202 boot during manufacturing. Moreover, when the skate boot 202 is heat molded to a particular skater's foot, the side panel 210 custom forms to their foot shape. In some embodiments, the side panel 210 can include a synthetic leather 810 to provide an aesthetically pleasing skate boot design. In addition, one or more portions 812 can be removed from the synthetic leather 810 revealing the thermoplastic 808, which can be used to display company graphics and/or logos if desired.

Figure 9:
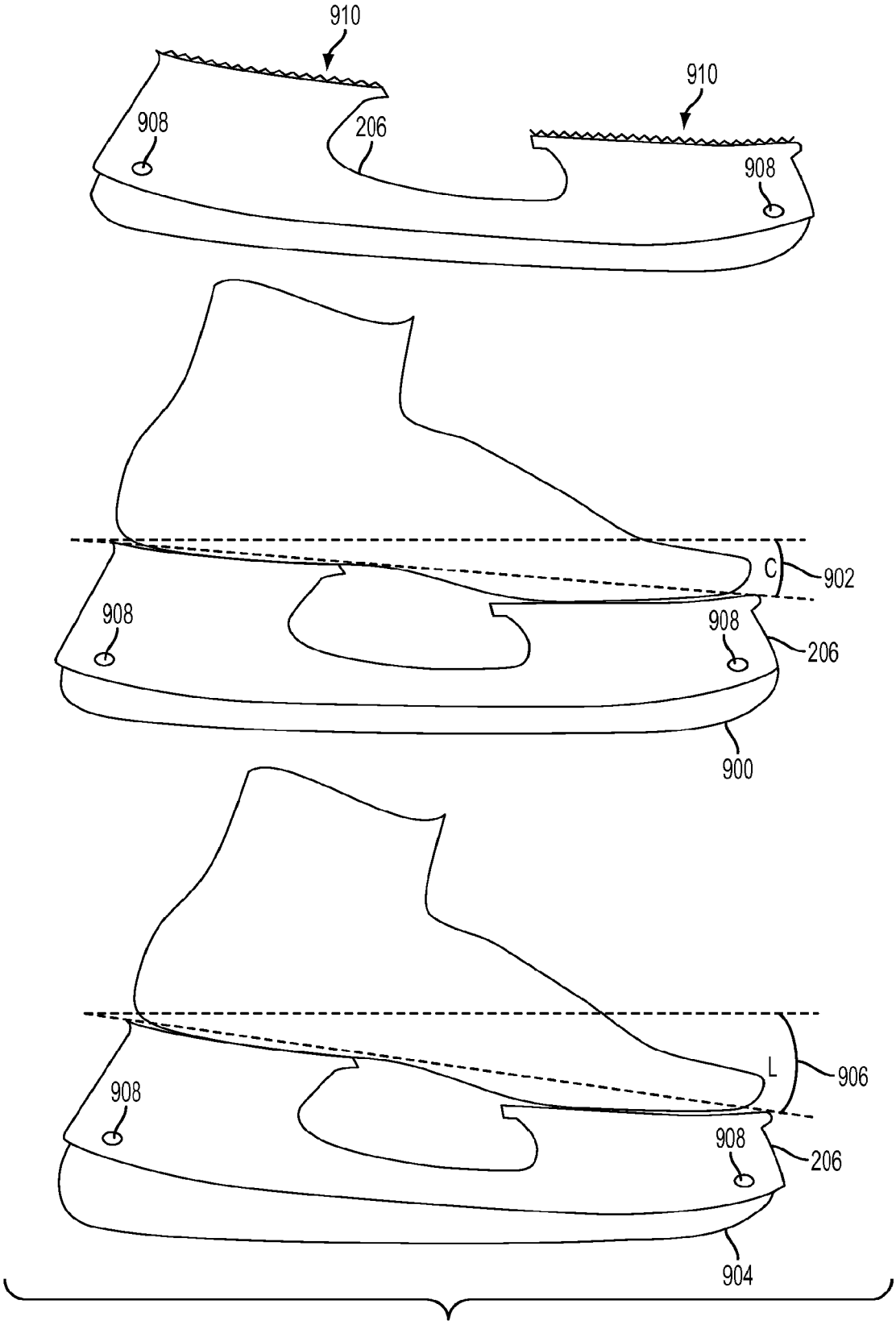
FIG. 9 is an exemplary diagram of a blade holder according to the present disclosure.

Referring now to FIG. 9, an exemplary diagram of the blade holder 206 having various blade profiles attached is depicted. The blade holder 206 can be attached to various blade profiles that have different radial profiles in order to achieve variations of sagital plane foot to ice angles. For example, the blade holder 206 can hold a substantially uniform blade 900 that provides a first foot to ice angle 902 if desired. In addition, the blade holder 206 can hold a raised heel blade 904 that provides a second foot to ice angle 906 if desired. Furthermore, the blade holder 206 can hold a raised toe blade (not shown) that provides a third foot to ice angle (not shown) if desired. Accordingly, the skate 200 can be customized to each particular skaters requirements in order to provide greater comfort and/or skating performance.

The skate blades are attached to the blade holder 206 via attachment points 908 at each end of the blade holder 206. By having the attachment points 908 at each end of the blade holder 206, the blade can flex when the skater applies force to the skate 200, which can result in improved control while skating. The further the attachment points 908 are from each other, the more the blade flexes. The attachment points 908 can be any suitable distance apart to achieve the desired flex. For example, a 30.9 cm blade can have the attachment points 908 separated by approximately 25.3 cm if desired. In another example, one of the attachment points 908 can be approximately 3.2 cm from the front of the blade holder 206 and the other attachment point 908 can be 2.5 cm from the back of the blade holder 206 although other distances are contemplated.

The skate blades can be attached to the blade holder 206 in any suitable manner. For example, in one embodiment, a suitable bolt and nut can be used to attach the skate blade to the blade holder 206. As such, in this embodiment, the skate blade and the blade holder 206 can be removably attached so that the skate blade can be easily replaced. Other attachment methodologies are contemplated.

In one embodiment, the blade holder 206 includes a textured surface 910 that has a rough or slightly spiky surface. For example, in one embodiment, the textured surface 910 can be comparable to that of sand paper, such as 60 grit or other suitable grit sandpaper. The textured surface 910 engages with the bottom of the skate boot 202 (e.g., the shell structure 208) when attached to the skate boot 202. As such, the textured surface 910 causes the blade holder 206 to bite into the skate boot 202 and thus inhibits medial and/or lateral movement of the blade holder 206 with respect to the skate boot 202.

Figure 10:
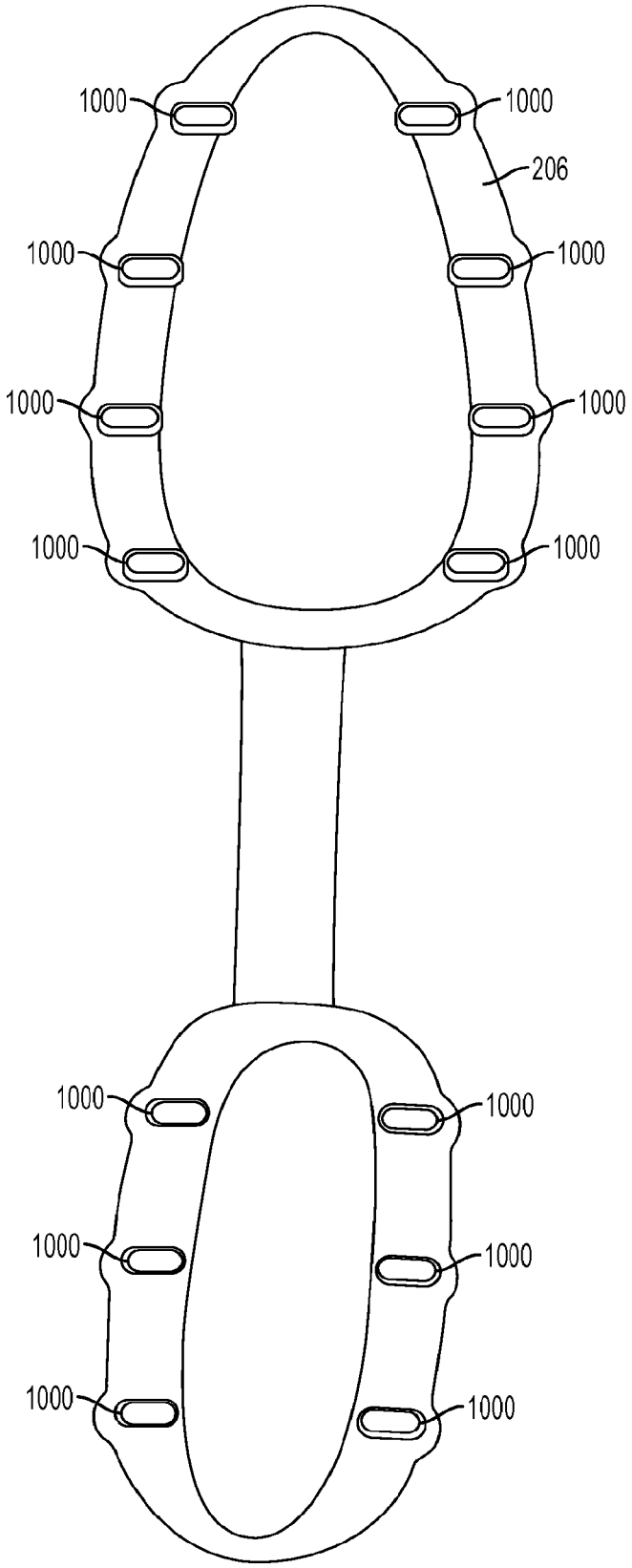
FIG. 10 is another exemplary diagram of the blade holder.
Figure 11:
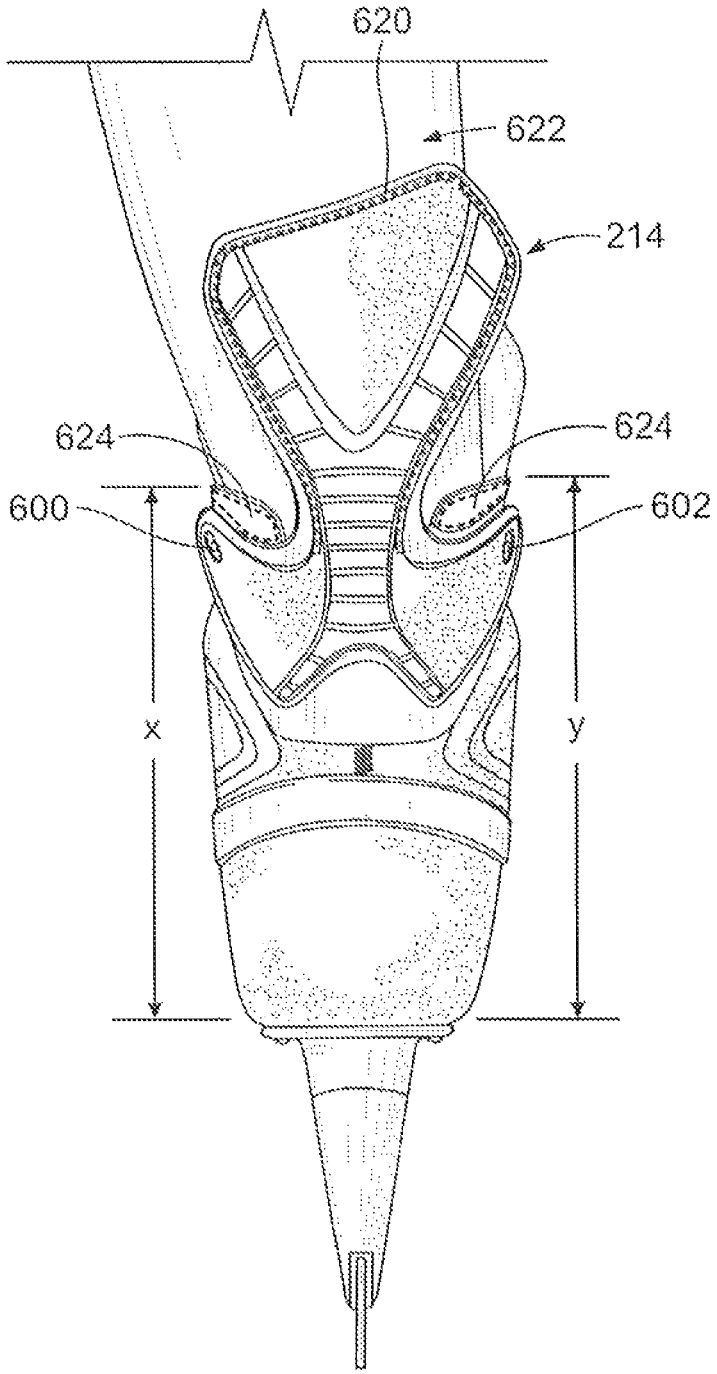
FIG. 11 is an exemplary rear diagram of a skate on a wearer, with the skate including a removable tendon guard according to an alternative embodiment.

Referring now to FIG. 10, a top view of the blade holder 206 is depicted. The blade holder 206 can be made from any suitable polymer material known in the art. For example, in one embodiment, the blade holder 206 can be made of ST 801 Dupont PS Nylon 66. In another embodiment, the blade holder 206 can be made from a polymer having more flexibility such as pebax Nylon elastomer, for example. The advantage of using different polymers having different flexibility provides a skater greater customization to improve performance and/or comfort. For example, a skater that wishes to accelerate faster may choose to use a blade holder made of a more flexible material such as pebax Nylon elastomer, for example. However, a skater that wishes to have a higher top end speed may choose to use a blade holder made of a more rigid less flexible material such as ST 801 Dupont PS Nylon 66, for example.

The blade holder 206 includes multiple attachment points 1000 that can be attached to the skate boot 202 (e.g., the shell structure 208) via any suitable means such as a nut and bolt, a rivet, and/or other suitable attachment means. In this example, there are eight attachment points 1000 (i.e., four on each side) on the front portion of the blade holder 206 and six attachment points 1000 (i.e., three on each side) on the rear (or heel) of the blade holder 206 although any suitable number of attachment points 1000 may be used if desired.

The attachment points 1000 are apertures having an elongated shape such as a slot, elliptical, or other suitable elongated shape. Due to the elongated shape of the apertures, a skater can adjust the position of the blade holder 206 with respect to the skate boot 202 as desired. For example, the blade holder 206 can be adjusted laterally in order to center the blade for each particular skater's center of gravity. As such, the blade holder 206 is adjustable with respect to the skate boot 202 and thus can be adjusted to enhance comfort and/or performance for a particular skater.

As noted above, the blade holder 206 includes the textured surface 910 to ensure that there is no slippage of the blade holder 206 with respect to the skate boot 202 during skating. In one embodiment, the bottom side of the skate boot 202 can be coated with polyurethane or bonded with a thin piece of leather to further aid the textured surface 910 in preventing movement between the skate boot 202 and the blade holder 206.

Among other advantages, the skate 200 provides increased mobility and freedom of movement of a skater's foot due to the notch 406, the flexible tendon guard 214 (which may include a sloped upper surface to reduce or prevent engagement of the tendon guard with a lateral side of a wearer's leg), and/or the lowered lateral region of the ankle portion of the boot. These features facilitate natural motion of the skating stride, which yields optimal power on each stride and results in increased skating speed and/or acceleration of the skater. Further, laterally-directed energy is not wasted because the medial and lateral walls of the skate boot do not need to sway. The skate 200 also promotes improved balance and proper athletic positioning without undue restriction from the boot material.

In addition, the skate 200 provides safety features suitable for impact sports such as hockey without compromising the mobility of the foot. Furthermore, the skate 200 has multiple components that are removably attached and/or adjustable so that a particular skater can customize the skate 200 to meet their individual needs. Other advantages will be recognized by those of ordinary skill in the art.

While this disclosure includes particular examples, it is to be understood that the disclosure is not so limited. Numerous modifications, changes, variations, substitutions, and equivalents will occur to those skilled in the art without departing from the spirit and scope of the present disclosure upon a study of the drawings, the specification, and the following claims.

What is claimed is:

1. A hockey skate boot, comprising:

a heel portion;

a toe portion;

a lateral side portion between the heel portion and the toe portion;

a medial side portion between the heel portion and the toe portion;

a lateral ankle portion extending above the heel portion;

a medial ankle portion extending above the heel portion; and an asymmetrical tendon guard attached to the boot and positioned above the heel portion, the tendon guard having an upper edge that slopes downward generally from a medial side toward a lateral side of the tendon guard.

2. The hockey skate boot of claim 1 wherein the lateral ankle portion has a first height, and the medial ankle portion has a second height that is greater than the first height.

3. The hockey skate boot of claim 2 wherein the height of the medial ankle portion is approximately 5 mm greater than the height of the lateral ankle portion.

4. The hockey skate boot of claim 1 wherein the lateral ankle portion and the medial ankle portion are spaced apart from each other to form a notch between them, wherein the tendon guard overlies the notch.

5. The hockey skate boot of claim 4 wherein the notch is generally U-shaped.

6. The hockey skate boot of claim 1 further comprising a first stopper on a rear-upper portion of the medial ankle portion and a second stopper on a rear-upper portion of the lateral ankle portion for inhibiting forward movement of the tendon guard.

7. The hockey skate boot of claim 1 wherein the tendon guard is attached to the lateral ankle portion and to the medial ankle portion.

8. The hockey skate boot of claim 1 wherein the tendon guard is removably attached to the lateral ankle portion and to the medial ankle portion.

9. The hockey skate boot of claim 8 wherein the tendon guard is removably attached to the lateral ankle portion and to the medial ankle portion via bolts.

10. The hockey skate boot of claim 1 wherein the tendon guard comprises a narrow mid-region about which the tendon guard is adapted to flex toward and away from the toe portion.

11. The hockey skate boot of claim 10 wherein the mid-region has a width that is less than 59% of a width of an upper region of the tendon guard.

12. A hockey skate boot, comprising:

a heel portion;

a toe portion;

a lateral side portion between the heel portion and the toe portion;

a medial side portion between the heel portion and the toe portion;

a lateral ankle portion extending above the heel portion;

a medial ankle portion extending above the heel portion;

a tendon guard attached to the boot and positioned above the heel portion; and means for providing increased freedom of movement for a wearer's leg in a lateral direction, wherein the means for providing increased freedom of movement comprises an upper edge of the tendon guard sloping downward generally from a medial side toward a lateral side of the tendon guard.

13. The hockey skate boot of claim 12 further comprising means for inhibiting forward movement of the tendon guard.

14. The hockey skate boot of claim 12 wherein the tendon guard is attached to the lateral ankle portion and to the medial ankle portion.

15. The hockey skate boot of claim 12 wherein the tendon guard is removably attached to the lateral ankle portion and to the medial ankle portion.

16. The hockey skate boot of claim 15 wherein the tendon guard is removably attached to the lateral ankle portion and to the medial ankle portion via bolts.

17. The hockey skate boot of claim 12 wherein the tendon guard comprises a narrow mid-region about which the tendon guard is adapted to flex toward and away from the toe portion.

18. The hockey skate boot of claim 17 wherein the mid-region has a width that is less than 59% of a width of an upper region of the tendon guard.

19. The hockey skate boot of claim 12 wherein the height of the medial ankle portion is approximately 5 mm greater than the height of the lateral ankle portion.

20. A hockey skate boot, comprising:

a boot body including a medial side and a lateral side; and an asymmetrical tendon guard attached to the boot body, the tendon guard having an upper edge that slopes downward generally from a medial side toward a lateral side of the tendon guard.

* * * * *